US007487769B2

(12) United States Patent
Lubben

(10) Patent No.: US 7,487,769 B2
(45) Date of Patent: Feb. 10, 2009

(54) PAINTBALL POD TANK HARNESS

(76) Inventor: Curtis Robert Lubben, 12057 Caminito Ryone, San Diego, CA (US) 92128

( * ) Notice: Subject to any disclaimer, the term of this patent is extended or adjusted under 35 U.S.C. 154(b) by 97 days.

(21) Appl. No.: 11/144,186

(22) Filed: Jun. 4, 2005

(65) Prior Publication Data

US 2005/0274370 A1 Dec. 15, 2005

Related U.S. Application Data

(60) Provisional application No. 60/578,919, filed on Jun. 14, 2004.

(51) Int. Cl.
*F41B 11/02* (2006.01)

(52) U.S. Cl. ..... 124/45; 124/74

(58) Field of Classification Search ..... 124/45, 124/74; 206/315.11; 220/735, 736; 224/148.3, 224/148.4, 148.5, 148.6, 148.7, 250, 251
See application file for complete search history.

(56) References Cited

U.S. PATENT DOCUMENTS 4,401,245 A * 8/1983 Zills ..... 224/148.3
4,673,117 A * 6/1987 Calton ..... 224/148.3
4,871,597 A * 10/1989 Hobson ..... 428/36.1
4,974,761 A * 12/1990 Luque ..... 224/148.6
5,392,975 A * 2/1995 Blankenship, Jr. ..... 224/148.5
5,429,265 A * 7/1995 Maire et al. ..... 220/522
5,971,200 A * 10/1999 Reynolds ..... 220/694
6,085,902 A * 7/2000 Fang ..... 206/373
6,401,993 B1 * 6/2002 Andrino ..... 224/148.5
6,938,761 B2 * 9/2005 Nish ..... 206/315.11

* cited by examiner

*Primary Examiner*—John Ricci
(74) *Attorney, Agent, or Firm*—Eric Hanscom; Todd Langford

(57) ABSTRACT

The invention is directed toward a device and method for attaching one or more paintball pods the underside of the air canister of a paintball marker. A band of material encircles the canister, either covering the entire bottom and mid-section of the canister as a one-piece jacket or cover, or encircling the canister through a flat harness body with a retaining loop around which double-sided Velcro® cinches the harness body to the canister. The harness can be made of a number of different materials with some combination of non-skid and cushioning characteristics. The device protects the air canister, makes retrieving paintball pods easy and efficient, and presents a much smaller target than do other means of providing replacement paintballs. The invention also allows the player to gain mobility, as he/she does not have to deal with paintball pods flopping around during running, diving, crouching, jumping and crawling activities.

6 Claims, 3 Drawing Sheets

PAINTBALL POD TANK HARNESS

CROSS REFERENCE TO RELATED APPLICATIONS

This utility patent application claims benefit of a provisional application, No. 60/578,919, with a filing date of Jun. 14, 2004, filed in the name of current applicant Curtis Lubben, with the title "Paintball pod tank harness".

STATEMENT REGARDING FEDERAL FUNDING

There was no federal funding related to this application.

BACKGROUND OF THE INVENTION

The invention is directed toward a device and method for attaching one or more paintball pods to the underside of the air canister of a paintball marker. A band of material encircles the canister, either covering the entire bottom and mid-section of the canister as a one-piece jacket or cover, or encircling the canister through a flat harness body with a retaining loop around which double-sided Velcro® cinches the harness body to the canister. The harness can be made of a number of different materials with some combination of non-skid and cushioning characteristics. The device protects the air canister, makes retrieving paintball pods easy and efficient, and presents a much smaller target than do other means of providing replacement paintballs. The invention also allows the player to gain mobility, as he/she does not have to deal with paintball pods flopping around during running, diving, crouching, jumping and crawling activities.

Paintball appears to have originated as a method for farmers and ranchers to quickly and effectively mark tress and livestock. A paintball is a sphere filled with one of several colors of paint, contained by a hard, semi-brittle surface that breaks upon contact with another surface. The paintballs are shot out of a paintball gun, which is also called a "marker". An air canister attached to the paintball gun supplies the power to propel the paintball up to several hundred yards, although the effective range is usually under 150 feet, and the ideal distance to target is less than 80 feet, at a velocity around 190 mph.

During the early 1980's, it became an organized activity during which teams of paintball players would hunt one another in either an indoor or outdoor paintball arena. In paintball games the object is to shoot a player on the opposing team such that your paintball bursts or breaks on his/her clothing or gun, creating an obvious stain. All persons so marked by a paint splatter over a certain size (usually the size of a quarter) are supposed to put their paintball gun in the air and walk off the playing field.

By the end of the 1980's there were a number of paintball arenas throughout the world, ranging in quality from carefully designed indoor locations to cordoned-off outdoor lots where the only protection from enemy fire were naturally growing trees and naturally occurring hills and valleys. The goals of paintball games also expanded, from an initial "capture the flag" approach to the currently popular goal of shooting every member of the opposing team before they shoot every member of your team, commonly referred to as "elimination".

As the playing fields, rules, and cash prizes for paintball competitions have grown, there have been concurrent advances in the technology. Two of the major areas of improvement from the beginning have been to a) decrease the target size of a paintball player by making accessories small and/or locating them in front of or behind the person (as opposed to having accessories hang to the side of the player, thereby increasing the player's silhouette and target size), and b) facilitate a rapid re-supply of paintballs to the paintball gun.

An average paintball gun can only store around 200 paintballs in its hopper, depending upon the size of the hopper. It should be noted that the larger the hopper, the larger the target presented to an opponent, so carrying a larger hopper has its disadvantages as well as its advantages. One of the main goals in improving paintball gear is to decrease the effective target size a player presents so that it is more difficult to hit him or her with a shot paintball. Thus, once a user has exhausted the hopper, he/she needs to replenish the paintballs. There have been invented a number of ways to accomplish this, the most common being the use of paintball "pods", which currently come in sizes of 100 and 140 paintballs. Prior methods of storing pods include placing them on belt loops. This method has obvious drawbacks: if the pods are placed on a person's hips, they will effectively increase the target area, thereby rendering a user more likely to get shot; if the pods are attached to the front or back, a user increases the chances of crushing the paintballs by falling on them, or, even worse, incurring an injury by falling on the cylinders. Pod location is also a major comfort issue.

When the pods are dipped onto the front, the player has difficulties crouching (to minimize target size) or crawling, as is frequently needed to move safely across a playing field. Pods clipped onto a player's back expose extra surface area on a crouched player turned sideways, as well as being difficult to reach when a player needs to refill his/her marker. Other methods of attaching pods have been to the legs and wrists of a user, both of which again would increase the player's silhouette and target area, and as with the waist attachments, hinder the user's ability to quickly and effectively retrieve a paintball pod. The small size that can be effectively carried on a wrist also greatly diminishes the effectiveness of carrying wrist pods, as the exposure a player takes on by putting his/her marker down to fumble with wrist pods is frequently not worth the ten or so extra paintballs obtained from the pod.

An additional problem facing players is that one of the more sensitive (and expensive) parts of a paintball gun is the air canister and its connection to the gun. Since paintball involves a lot of falling down, both intentionally to present a small target and/or to stead the gun for firing, and unintentionally due to lack of balance or being struck unexpectedly by an opposing player's paintball, protecting the air canister and its connection is of crucial importance to the paintball player. Paintball guns are also dropped on occasion, either during the heat of battle in a paintball game, or when being stored while not in use.

The current invention provides a simple, cost-effective solution to both of these problems: a paintball pod tank harness which allows a user to attach one or more pods to the underside of the air canister, thereby not only cushioning the air canister from the jolt of hitting the ground during a fall, but also providing the user with a ready, easily accessible supply of replacement paintballs, from a location and in a configuration that presents a much smaller target than do other means of providing replacement paintballs. The invention also allows the player to gain mobility, as he/she does not have to deal with paintball pods flopping around during running, diving, crouching, jumping and crawling activities.

SUMMARY OF THE INVENTION

The primary object of this invention is to provide a fast, safe, and effective means of replenishing paintballs during a paintball game through the use of a harness which can attach one or more paintball pods directly to the air canister of a paintball gun.

Another object of this invention is minimizing the surface area presented by the additional pods of paintballs by locating them under the air canister, turned on their sides to present the minimum possible surface area to an opposing player.

An additional object of this invention is to create a product, namely a pod tank harness, which can be manufactured in of different sizes to accommodate the different sizes of air canisters used in paintball.

A further object of this invention is to cushion the air canister to protect it if and when the user drops to the ground, either intentionally or unintentionally, or when the paintball gun is dropped accidentally, said cushioning being accomplished not only by the protective harness, but also by the pod of paintballs being stored beneath the canister.

Other objects and advantages of the present invention will become apparent from the following description, taken in connection with the accompanying drawings, wherein, by way of illustration and example, and embodiment of the present invention is disclosed.

DETAILED DESCRIPTION OF THE INVENTION

This invention is directed toward a method of attaching paintball pods to an air canister in a manner which minimizes the target silhouette of the user, allows him/her to replace paintballs with relative ease, safety, and efficiency, and provides for a method of protecting both the unshot paintballs and the air canister along with its point of connection to the paintball gun.

The invention comprises several components. There is a harness body, which is a flat sheet of fabric, neoprene, plastic or other suitable material that is designed to fit around an air canister, or alternatively, a piece of fabric, neoprene, plastic or other suitable material that is produced already contoured to fit around an air canister. The inside of the harness body can be padded with neoprene or another cushioning material to protect the air canister and its delicate point of connection with the paintball gun, and can be made of a non-skid or non-slip material such as neoprene, to prevent the harness body from slipping off, sliding around, or riding up the air canister. The harness body can fit around the air canister either by cinching it down snugly through Velcro, snaps, zippers, or another means of attachment, in which the attachment end of the harness body is slid through a wrap-back clasp, and secured back onto itself, or by having the harness body be made in a cylinder itself where it slides over the air canister.

Attached to the outer surface of the harness body are one or more sleeves or pod holders for containing or holding pods, which have a variety of iterations, ranging from a simple, snug fitting loop of the same material the body harness is made of, to more complex versions where the paintball pod holder has a bottom and a top flap which can be attached over the top of the paintball pod to secure it in position. Because the paintball pods are located beneath the air canister, they will naturally give some protection to the air canister and its connection to the paintball gun. To add additional protection, not only to the air canister and its connection to the paintball gun but also to the paintballs contained within the paintball pod, there can be a layer of neoprene or other cushioning material placed inside the paintball pod holder. This material can, as with the layer that can be placed on the inside surface of the harness body, be made of a non-skid material to further secure the paintball pod within the paintball pod holder, to decrease the chances that the paintball pod will slip out of the pod holder.

Figure 1:
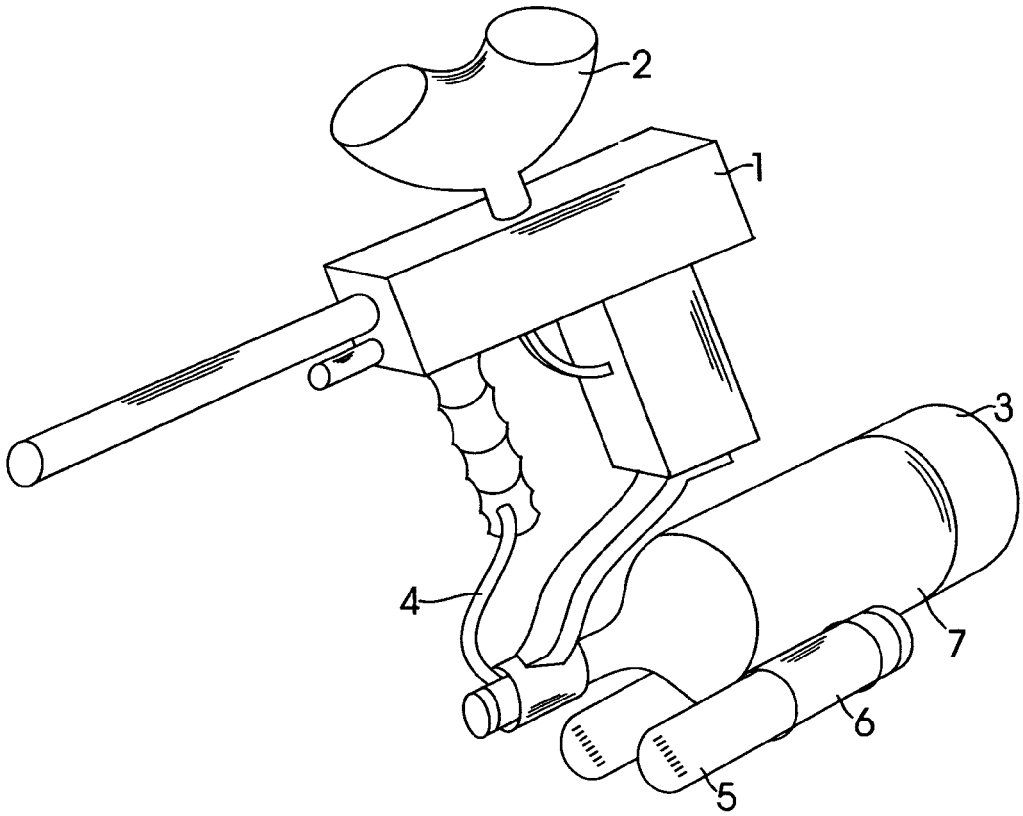
FIG. 1 is a front, partial side, partial elevational view of the paintball marker, the air canister, and the pod tank harness attached beneath the air canister.

Turning to the figures, FIG. 1 is a front, partial side, partial elevational view of the paintball marker (1), the hopper (2), the air canister (3), the air supply line (4) which supplies air from the air canister (3) to the marker (1), and the pod tank harness (7) attached beneath the air canister. Since most hoppers hold less than 200 paintballs at a time, and a paintball player, depending on the skill of the player and whether he/she is playing in a casual game or in a tournament, may go through several hundred paintballs during a game, there is a need for the player to be able to easily and efficiently reload the hopper (2). The invention provides a quick and easy solution to this problem. The harness (7), shown in this iteration of the invention as the "wrap-around" version, is cinched securely onto the air canister (3). Projecting below the harness (7) are two pod holders (6), both containing a pod (5). In this iteration, the pod holders do not have a top flap to retain the pods within the pod holders, but it is envisioned that by making the pod holders of an elastic and/or non-skid material, and by making the pod holders slightly smaller in diameter than the pods, the pods (5) will be effectively retained within the pod holders (6) until the player removes them.

Figure 2:
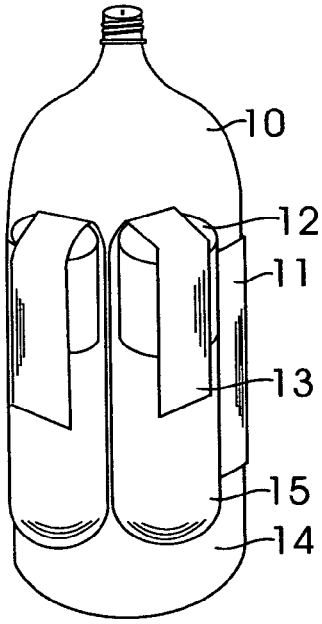
FIG. 2 is a side view of an air canister with two paintball pods attached via a harness body which wraps around the mid-section of the air canister in the "wrap-around" iteration of the invention.

FIG. 2 is a side view of an air canister (10) with two paintball pods (12) attached via a harness body (11) which wraps around the mid-section of the air canister in the "wrap-around" iteration of the invention, leaving the bottom section (14) of the air canister (10) uncovered. In this iteration, the pod holders (15) have top flaps (13) which can secure the pods (12) within the pod holders (15). It is envisioned that the top flaps (13) can secure the pods (12) through either mating strips of Velcro®, snaps, magnets, or other means of attachment between the underside of the top flaps (13) and the outside of the harness body (11) directly in line with where the top flap touches the Pod holder (13) when a pod (12) is inserted into the pod holder (15)

Figure 3:
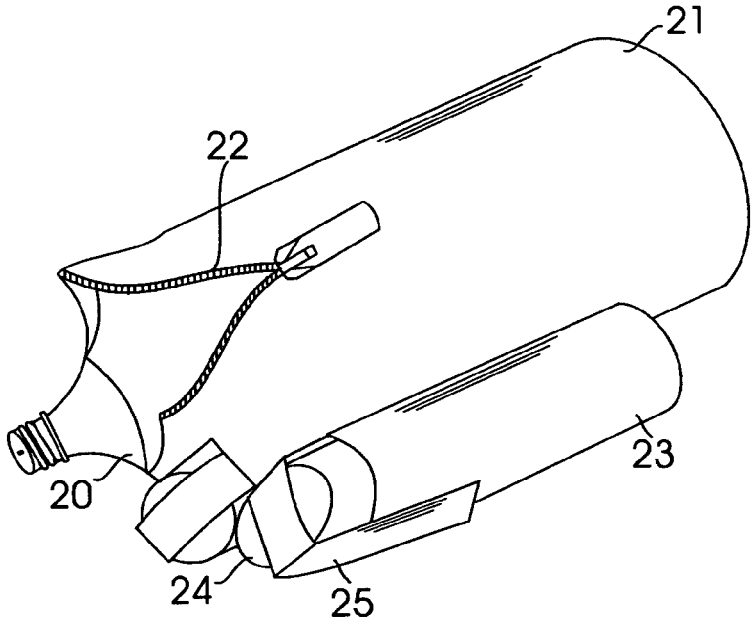
FIG. 3 is a partial elevational view of the invention in its "jacket" iteration, showing the jacket cover after it has been slid over the air canister, with two pods inserted into the pod holders with the top flaps in secured position.

FIG. 3 is a partial elevational view of the invention in its "jacket" iteration, showing the jacket cover (21) after it has been slid over the air canister (20), with two pods (24) inserted into the pod holders (23) with the top flaps (24) in secured position. A zipper (22) allows the user to tighten and secure the jacket cover (21) over the air canister (20). It should be noted that the jacket cover (21) iteration offers superior protection for the delicate air canister (20) than does the wrap-around iteration (not shown in this figure).

Figure 4:
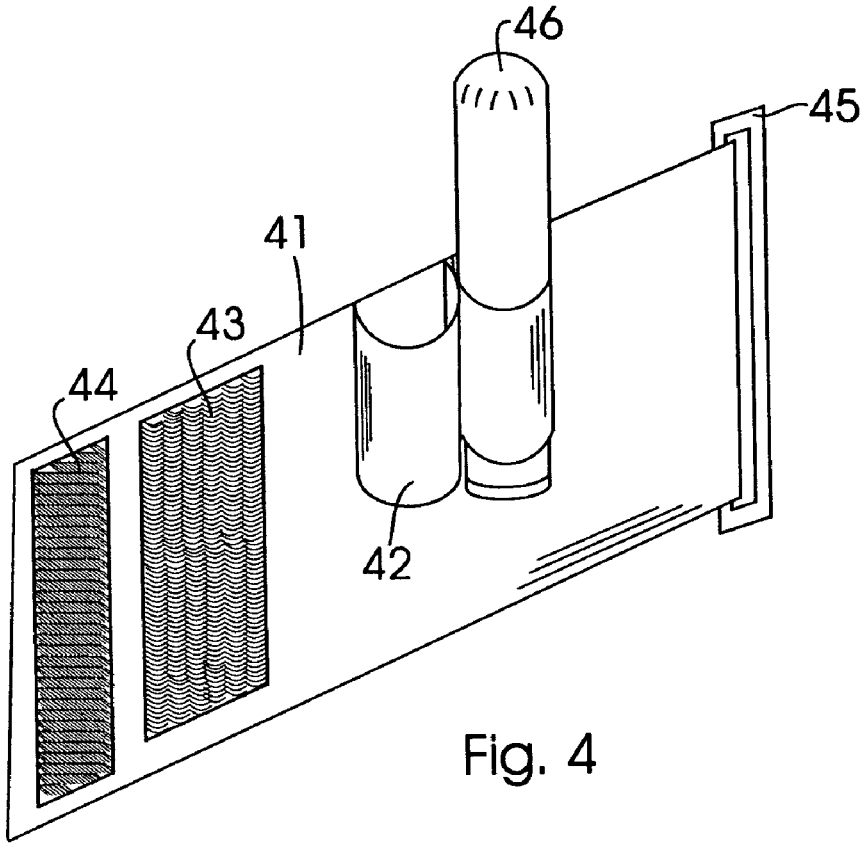
FIG. 4 is a front elevational, partial side view of the harness body removed from the tank, with one paintball pod inserted, where the harness body is the "wrap-around" iteration.

FIG. 4 is a front elevational, partial side view of the harness body (41) removed from the tank, with one paintball pod (43) inserted into one of the two pod holders (42), where the harness body is the "wrap-around" iteration. While the invention is normally shown with two pod holders (42), it should be noted that the inventor envisions the use of one, two, three, or more pod holders depending on the needs of the paintball player. To secure the harness body (41) around the air canister (not shown in this figure), one end of the harness body (41) has a hook strip (44) and a loop strip (43) of Velcro®, which can slide through a cinch loop (45) at the other end of the harness body (41), be pulled back against itself, and cinched down on the air canister. It should be noted that the harness iteration allows a user to use the same harness body (41) on a variety of different sized air canisters.

Figure 5:
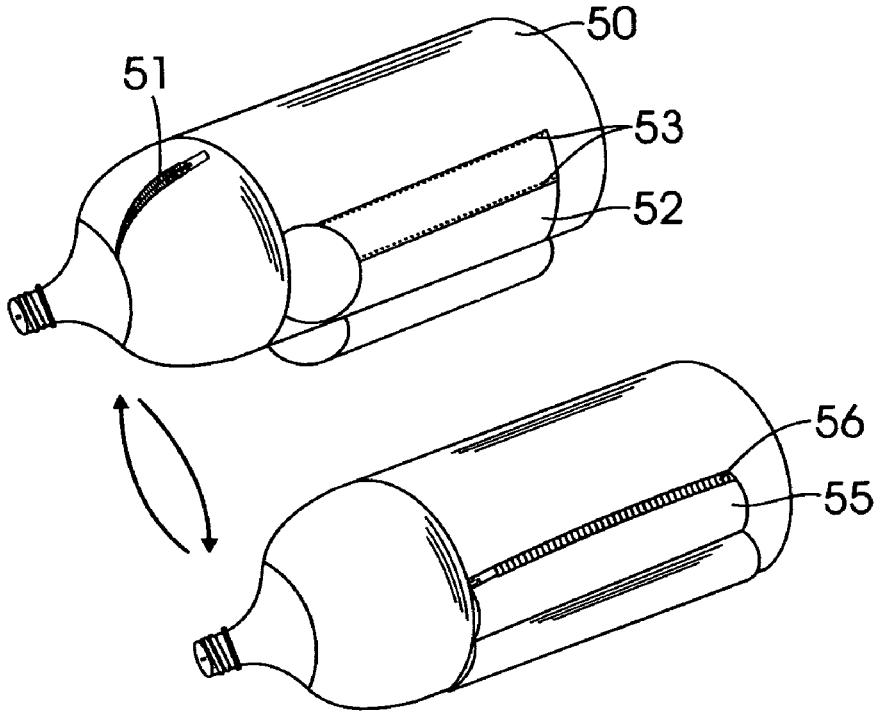
FIG. 5 is a front elevational view of the "jacket" iteration of the invention showing how the invention can have, optionally, two matching zippers such that when the pod holders are not in use the zippers can be zipped to close the pod holder and thereby present a small surface area or target to an opposing player.

FIG. 5 is a front elevational view of the "jacket" iteration of the invention showing how the invention can have, optionally, two mating zippers (53) such that when the pod holders (52) are not in use the zippers can be zipped together, as illustrated by (56), to close the pod holder (55) and thereby present a small surface area or target to an opposing player. The iteration as shown here is the jacket cover (50) with a zipper (51), but it should be noted that the collapsible pod holder techniques shown here are equally applicable to the wrap-around version.

Figure 6:
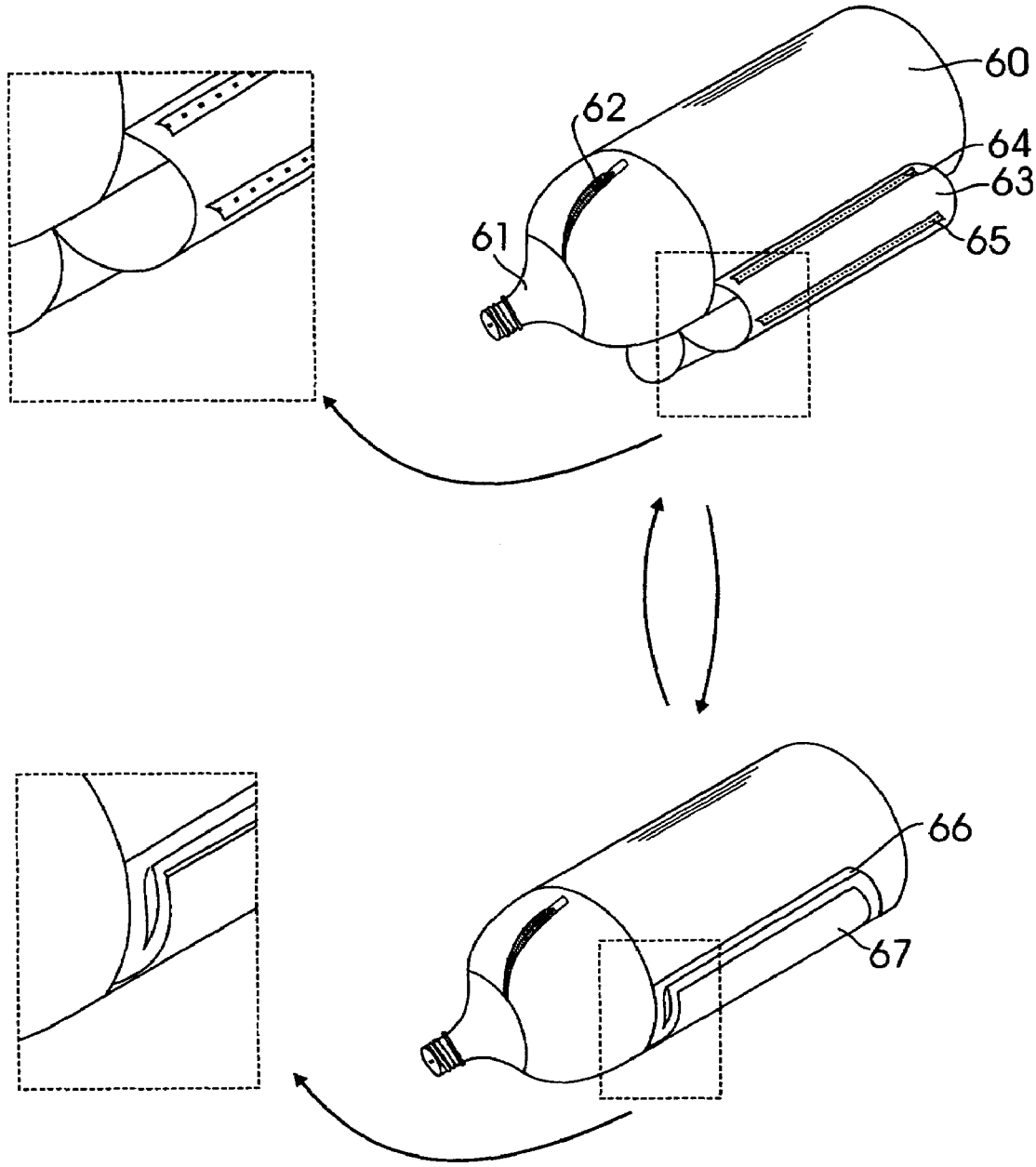
FIG. 6 is a front elevational view of the "jacket" iteration of the invention showing how the invention can have, optionally, two matching sets of snaps, Velcro®, or other means of attachment, such that when the pod holders are not in use the means of attachment can be attached to each other to close the pod holder and thereby present a small surface area or target to an opposing player.

FIG. 6 is a front elevational view of the "jacket" iteration of the invention showing how the invention can have, optionally, two matching sets of snaps (64 and 65), Velcro®, or other means of attachment, such that when the pod holders (63) are not in use the means of attachment can be attached to each other (66) to close the pod holder (67) and thereby present a small surface area or target to an opposing player. The iteration as shown here is the jacket cover (60) with a zipper (62), securing the jacket cover (60) to the air canister (61), but it should be noted that the collapsible pod holder techniques shown here are equally applicable to the wrap-around version.

The drawing constitutes a part of this specification and includes exemplary embodiments to the invention, which may be embodied in various forms. It is intended that in some instances various aspects of the invention may be shown exaggerated or enlarged to facilitate an understanding of the invention.

What is claimed is:

1. An air canister harness for attaching one or more pod holders to the air canister of a paintball marker, the harness comprising:

a harness body having a harness body inner surface and a harness body outer surface, where, the harness body inner surface has attached to it a layer of neoprene or other cushioning material to protect the air canister from being damaged and to keep the harness body from slipping off or riding up on the air canister;

means for attaching the harness body to an air canister; and one or more paintball pod holders having a paintball pod holder inner surface and a paintball pod holder outer surface, the one or more paintball pod holders attached to the harness body outer surface and having an open end wherein a paintball pod can be inserted therethrough, the one or more paintball pod holders further including a strap attached along a portion of the open end for securing the paintball pod within the one or more paintball pod holders such that at least a portion of the paintball pod is exposed when the paintball pod is secured within the one or more paintball pod holders, where the harness comprises a flat piece of fabric, plastic, or similar flexible material which serves as a harness body, the harness body having a harness body inner surface which is intended to be wrapped around an air canister and a harness body outer surface, where the harness body is constructed in one circular piece designed to fit around the air canister, and a harness body top end and a harness body bottom end, where the means for attaching the harness body to an air canister comprises a zipper that extends at least part of the way from the harness body top end to the harness body bottom end, where, by zipping up the zipper, the user can cinch down or constrict the harness body around the air canister, where the paintball pod holder is a flat piece of fabric, plastic, or similar flexible material attached to the harness body outer surface in a semi-circular pattern, such that a paintball pod can be snugly pushed into the paintball pod holder, where the paintball pod holder inner surface has attached to it a layer of neoprene or other cushioning material to protect the paintballs in the paintball pod from being crushed and to decrease the likelihood that the paintball pod will be ejected from the paintball pod holder during a game of paintball.

2. The device of claim 1, where:

the paintball pod holder has a bottom against which the paintball pod will rest when inserted into the paintball pod holder.

3. The device of claim 2, where:

the paintball pod holder has a top flap which consists of a flat piece of fabric, plastic, or similar flexible material attached to the tank harness in such that after the paintball pod is pushed into the paintball pod holder, the top flap can be pulled over the exposed end of the paintball pod and secured to the paintball pod holder upon the paintball pod holder outer surface.

4. The device of claim 3, where:

the means of securing the top flap to the paintball pod holder is a strip of hooks of hook and loop fasteners used with a strip of loops of hook and loop fasteners, comprising, a section of hooks of hook and loop fasteners attached to surface of the top flap, a section of loops of hook and loop fasteners attached to the paintball pod holder outer surface in a location which will allow the hooks of the hook and loop fasteners to attach to the loops of the hook and loop fasteners such that the paintball pod will be held securely in the paintball pod holder.

5. A method for attaching one or more pod holders to the air canister of a paintball marker, comprising:

taking an air canister harness for attaching one or more pod holders to the air canister of a paintball marker, where the air canister harness comprises:

a harness body, having a harness body inner surface and a harness body outer surface, where, the harness body inner surface has attached to it a layer of neoprene or other cushioning material to protects the air canister from being damaged and to keep the harness body from slipping off or riding up on the air canister, means for attaching the harness body to an air canister; and one or more paintball pod holders having a paintball pod holder inner surface and a paintball pod holder outer surface, the one or more paintball pod holders attached to the harness body outer surface and having an open end wherein a paintball pod can be inserted therethrough, the one or more paintball pod holders further including a strap attached along a portion of the open end for securing the paintball pod within the one or more paintball pod holders such that at least a portion of the paintball pod is exposed when the paintball pod is secured within the one or more paintball pod holders;

taking the air canister harness; and attaching the air canister harness to an air canister, where the paintball pod holder is a flat piece of fabric, plastic, or similar flexible material attached to the harness body outer surface in a semi-circular pattern, such that a paintball pod can be snugly pushed into the paintball pod holder, where, the paintball pod holder inner surface has attached to it a layer of neoprene or other cushioning material to protect the paintballs in the paintball pod from being crushed and to decrease the likelihood that the paintball pod will be ejected from the paintball pod holder during a game of paintball, where the paintball pod holder has a bottom against which the paintball pod will rest when inserted into the paintball pod holder, where the paintball pod holder has a top flap which consists of a flat piece of fabric, plastic, or similar flexible material attached to the tank harness in such that after the paintball pod is pushed into the paintball pod holder, the top flap can be pulled over the exposed end of the paintball pod and secured to the paintball pod holder upon the paintball pod holder outer surface, and, where the means of securing the top flap to the paintball pod holder is a strip of hooks of hook and loop fasteners used with a strip of loops of hook and loop fasteners, comprising, a section of hooks of hook and loop fasteners attached to surface of the top flap, a section of loops of hook and loop fasteners attached to the paintball pod holder outer surface in a location which will allow the hooks of hook and loop fasteners to attach to the loops of hook and loop fasteners such that the paintball pod will be held securely in the paintball pod holder.

6. The method of claim 5, where the air canister harness additionally comprises:

where the harness comprises a flat piece of fabric, plastic, or similar flexible material which serves as a harness body, the harness body having a harness body inner surface which is intended to be wrapped around an air canister and a harness body outer surface, where the harness body is constructed in one circular piece designed to fit around the air canister, and a harness body top end and a harness body bottom end, and, where the means of attaching the harness body to an air canister comprises a zipper that extends at least part of the way from the harness body top end to the harness body bottom end, where, by zipping up the zipper the user can cinch down or constrict the harness body around the air canister.

* * * * *